US006086648A

United States Patent [19]

Rossetti, Jr. et al.

[11] Patent Number: 6,086,648

[45] Date of Patent: Jul. 11, 2000

[54] BONDED ABRASIVE ARTICLES FILLED WITH OIL/WAX MIXTURE

[75] Inventors: George A. Rossetti, Jr., Woburn; Stephen E. Fox; Marc J. M. Tricard, both of Worcester, all of Mass.

[73] Assignee: Norton Company, Worcester, Mass.

[21] Appl. No.: 09/056,475

[22] Filed: Apr. 7, 1998

[51] Int. Cl.[7] ..... B24D 3/34; B24D 3/18

[52] U.S. Cl. ..... 51/304; 51/295; 51/306; 51/309; 451/28

[58] Field of Search ..... 51/295, 296, 304, 51/306, 309; 451/28, 49

[56] References Cited

U.S. PATENT DOCUMENTS

| | | | |
|---|---|---|---|
| 1,325,503 | 12/1919 | Katzenstein . | |
| 2,687,357 | 8/1954 | Fiser | 106/268 |
| 2,829,035 | 4/1958 | Doughty et al. | 51/304 |
| 3,502,453 | 3/1970 | Baratto | 51/295 |
| 3,664,819 | 5/1972 | Sioui et al. | 51/295 |
| 3,779,727 | 12/1973 | Siqui et al. | 51/298 |
| 3,804,600 | 4/1974 | Holman | 29/182.5 |
| 3,868,232 | 2/1975 | Sioui et al. | 51/298 |
| 4,071,333 | 1/1978 | Like | 51/304 |
| 4,190,986 | 3/1980 | Kunimasa | 51/295 |
| 4,239,501 | 12/1980 | Wirth | 51/281 |
| 4,378,233 | 3/1983 | Carver | 51/298 |
| 5,034,360 | 7/1991 | Bartels et al. | 501/127 |
| 5,037,453 | 8/1991 | Narayama et al. | 51/307 |
| 5,131,926 | 7/1992 | Rostoker et al. | 51/309 |
| 5,192,339 | 3/1993 | Hasegawa et al. | 51/309 |
| 5,302,564 | 4/1994 | Winkler et al. | 501/127 |
| 5,387,268 | 2/1995 | Hiraiwa | 51/309 |
| 5,607,489 | 3/1997 | Li | 51/295 |

FOREIGN PATENT DOCUMENTS

| | | | |
|---|---|---|---|
| 1775284A1 | 11/1992 | U.S.S.R. | B24D 3/34 |
| 2264719A | 9/1993 | United Kingdom | C23C 4/12 |

OTHER PUBLICATIONS

M.A. Younis, H. Alawi, "Effects Of Impregnation Of Grinding Hardened Tool Steel", *Transactions of the CSME,* vol. 9, No. 1, 1985, pp. 39–44 (No Month).

A. Kobayashi and T. Hanaoka, "How To Evaluate Grinding Performance (Of Treated Wheels And Grinding Fluids)", *Annals of the C.I.R.P.* vol. XIII, Ms. 86/51, Printed in Great Britain 1966, pp. 425–431 (No Month).

H. S. Cheng, "Introduction To Lubrication", *Lubricants And Lubrication,* pp. 79–80 (Date Unknown).

H. S. Cheng "Lubrication Regimes", *Lubricants And Lubrication,* pp. 89–97 (Date Unknown).

R. S. Fein, "Liquid Lubricants", *Lubricants And Lubrication,* pp. 81–88 (Date Unknown).

"Accu–Lube Complete Lubricating Systems. Good For The Environment. Great For Business.", ITW Fluid Products Group, Printed in U.S.A. Aug. 1992, pp. 1–16.

*Primary Examiner*—Michael Marcheschi
*Attorney, Agent, or Firm*—Mary E. Porter

[57] ABSTRACT

An abrasive article is provided for precision grinding purposes, and the article comprises 3 to 25 volume % vitreous bond, 3 to 56 volume % MCA abrasive grain, and 28 to 63 volume % open porosity. Substantially all porosity in the abrasive article is impregnated with a lubricant component consisting of an oil and wax mixture having an oil:wax weight ratio of about 3:1 to about 1:4.

18 Claims, No Drawings

BONDED ABRASIVE ARTICLES FILLED WITH OIL/WAX MIXTURE

FIELD OF THE INVENTION

This invention relates to abrasive tools for precision grinding. More specifically, it pertains to vitrified bonded abrasive tools impregnated with a lubricant component to improve grinding performance, particularly in dry grinding processes.

BACKGROUND

Precision grinding operations remove metal from an article at a moderately high rate to achieve a precisely shaped finished article having a specified size and surface quality. Typical examples of precision grinding include finishing bearing components and machining engine parts to fine tolerances. Coolants and lubricants frequently are used to improve the efficiency of precision grinding metal parts.

A "wet" method of cooling and lubricating involves bathing the grinding zone continuously during cutting with copious quantities of low temperature, fresh or recirculating liquid. Typically, the liquid is an aqueous composition containing minor concentrations of process aids. The liquid lowers grinding zone temperature to protect the tool and work piece from thermal degradation. It also flushes the tool to carry away swarf which might otherwise dull the abrasive if permitted to fill voids between abrasive particles or weld onto the particle surfaces.

There are numerous drawbacks to wet grinding. To name a few, the process is messy to operate; the liquid must be recovered for reuse or discarded in an environmentally sound manner; the presence of process aids contributes to the difficulty of recovery and adds to operating cost; the aqueous liquid can corrode parts of the grinding machinery; and the liquid is unpleasant to work with in a very cold, ambient environment.

Precision grinding also can be accomplished by a "dry" method. No flushing flow of liquid is externally applied to the grinding zone. To dry grind thermally-sensitive or difficult to grind metals, such as stainless steel, it remains desirable to lubricate the grinding zone. To accomplish this lubrication, lubricant traditionally has been supplied to the local grinding site by periodic application of solid lubricant to the face of the grinding tool, or by filling the pores of suitable abrasive such as those in vitreous abrasive tools with selected additives. Chemicals, such as sulfur, and other lubricating fillers have been used. These additives reduce loading and glazing of the abrasive, make the tool more free-cutting and reduce the incidence of burn. The additives are usually added to the abrasive after firing the bond to prevent thermal degradation of the additives and to permit proper formation of the abrasive during tool fabrication.

Dry grinding provides the advantageous feature that very little lubricant is consumed because the lubricant is deposited directly into the grinding zone. Moreover, the lubricant need not be water soluble because it is not brought to the grinding zone in cooling water. Unfortunately, additives placed in the pores, especially low viscosity liquids, are not retained in the abrasive tool for long duration. They tend to distribute unevenly in the wheel after long periods of standing, and they can partially or completely seep out of the wheel over time. In the important application of dry precision grinding using abrasive wheels operated at high speed, centrifugal force tends to expel pore-resident low viscosity liquid additives. The expelled additives splatter the work area and deplete the amount of additives available at the grinding site to aid grinding. It is desirable to provide vitreous bonded abrasive wheels which are loaded with uniformly distributed concentrations of predominantly low viscosity lubricants and which can deliver such lubricants to the grinding site over the full life of the abrasive.

Various materials have been suggested as additives for porous abrasive tools to improve grinding performance. Paraffin wax is an example of such a material. See, e.g., U.S. Pat. No. 1,325,503 to Katzenstein. Paraffin wax becomes tacky at a relatively low temperature and tends to cause loading of the face of the grinding wheel, an undesirable characteristic in precision grinding processes. A stearic acid material was reported to be superior to paraffin wax in: A. Kobayashi, et al, *Annals of the C.I.R.P.*, Vol. XIII, pp. 425–432, 1966.

U.S. Pat. No. 4,190,986 to Kunimasa teaches an improvement in grinding efficiency and a reduction in workpiece burn may be achieved by the addition of a heated mixture of higher aliphatic acids and higher alcohols to the pores of resin bonded grindstones. The patent discloses that, unlike resin bonded tools, vitrified bonded tools do not show an improvement in grinding efficiency. In vitrified bond tools the additive is reported to function only as a lubricant, and was not observed to improve grinding efficiency.

U.S. Pat. No. 3,502,453 to Baratto discloses resin bonded abrasive tools containing hollow spheres filled with lubricant, such as SAE 20 oil encapsulated in a urea-formaldehyde capsule. Graphite is used in the resin bonded superabrasive tools disclosed in U.S. Pat. No. 3,664,8 19 to Sioui. Graphite improves grinding efficiency and lubricates the workpiece during dry grinding operations.

U.S. Pat. No. 4,239,501 to Wirth teaches the application to the cutting surface of an abrasive tool of a combination of sodium nitrite and a wax, such as paraffin, cerate and stearic acid or microcrystalline waxes.

Sulfur is known to be an excellent lubricant for precision grinding of metal parts. In M.A. Younis, et al, *Transactions of the CSME*, Vol. 9, No. 1, pp. 39–44, 1985, sulfur was reported to be superior to waxes and varnishes as a grinding aid impregnated into grinding tools. However, previous attempts to use sulfur-loaded tools, particularly high rotational speed abrasive wheels, have been problematic. Because of combustion at the grinding temperatures, sulfur-containing abrasive tools are used only in wet grinding processes. Often after only brief operation, centrifugal force tends to redistribute sulfur within a grinding wheel. Because sulfur has a relatively high density, the wheel may becomes unbalanced, start to chatter, and become unusable for precision grinding.

Sulfurized cutting oils have been used as an alternative to sulfur impregnated abrasive grinding wheels in order to avoid balance problems, but the oils generally have low viscosity. Therefore, abrasive wheels loaded with such oils suffer from the drawbacks discussed above.

Wet grinding is the preferred way to precision grind at high speed when employing sulfur-based process aids. The sulfur is normally used in the form of a water soluble or dispersible, low viscosity metal cutting oil which is mixed with the coolant. This is a very inefficient use of sulfur because an excess amount of sulfurized oil must be added to the large volume of liquid coolant. Sulfur also is an environmental contaminant and spent coolant must be treated to remove sulfurized materials before disposal.

Thus, none of the prior art grinding additives has been entirely satisfactory for use in vitrified bonded abrasive tools for precision grinding operations, particularly as the environmental effects of sulfur and other active grinding aids become more difficult to manage.

The need for improved grinding aids for precision grinding operations became even more acute with the introduction of sintered sol gel alumina abrasive grains during the 1980s. Abrasive tools comprising seeded or unseeded sintered sol gel alumina abrasive grain, also referred to microcrystalline alpha-alumina (MCA) abrasive grain, are known to provide superior grinding performance on a variety of materials. The manufacture, characteristics and performance of these MCA grains in various applications are described in, for example, U.S. Pat. Nos. 4,623,364, 4,314,827, 4,744,802, 4,898,597 and 4,543,107, the contents of which are hereby incorporated by reference.

The MCA grain morphology is designed to cause microfracture of the grain particles during grinding. The microfracture capability prolongs the life of the abrasive grain by wearing away each grain particle a portion at a time rather than dislodging a whole particle. It also exposes fresh abrasive surfaces, in effect causing the abrasive to self-sharpen during grinding. Because of its extraordinary sharpness relative to other abrasive grains, the MCA grain is characterized by the ability to cut with a minimum amount of grinding energy when it is used for dry grinding processes employing a vitrified bonded tool. The threshold power needed to initiate dry grinding with MCA grain is essentially zero. Under wet grinding conditions utilizing a water-based coolant, the MCA grain does not perform as well with respect to the amount of power needed to initiate grinding. Because many precision grinding operations cannot tolerate dry grinding processes, even with MCA grain, it has been necessary to develop a lubricant component that is effective as a coolant and grinding aid for vitrified bonded abrasive tools containing MCA grain. The lubricant component of the invention is effective with MCA grains in either wet or dry grinding processes.

SUMMARY OF THE INVENTION

The present invention is an abrasive article for precision grinding, comprising 3 to 25 volume % vitreous bond, 3 to 56 volume % MCA abrasive grain, and 28 to 63 volume % pores, wherein substantially all open porosity in the abrasive article has been impregnated with a lubricant component consisting of a uniform mixture of oil and wax, having an oil:wax weight ratio of about 3:1 to about 1:4.

The abrasive articles for precision grinding are made by a method comprising the steps of:

(a) blending about 20–75 wt % oil and 25–80 wt % wax at a temperature above the softening point of the wax to form a uniformly mixed lubricant component;

(b) providing an abrasive article comprising about 3 to 25 volume % vitreous bond, 3 to 56 volume % MCA grain and 28 to 63 volume % pores;

(c) heating the lubricant component to a temperature where the lubricant component is in a liquid state and holding the lubricant component in a liquid state;

(d) heating the abrasive article to a temperature 20 to 30° C. higher than the temperature of the liquid lubricant component;

(e) contacting the abrasive article with the liquid lubricant component without submerging the abrasive article into the liquid lubricant component;

(f) rotating the abrasive article at a speed effective to avoid gas entrainment while maintaining contact with the liquid lubricant component to uniformly impregnate the abrasive article with lubricant component;

(g) removing the abrasive article from contact with the lubricant component after the abrasive article has absorbed an effective amount of lubricant component to fill substantially all open pores; and (h) continuing to rotate the abrasive article while cooling the abrasive article to uniformly solidify the impregnated liquid lubricant component within the pores.

In addition, the invention provides a method of precision grinding comprising the steps of:

(a) providing an abrasive article comprising a vitreous bond and a MCA abrasive grain having pores containing an effective amount of a lubricant component consisting essentially of about 20–75 wt % oil and 25–80 wt % wax; wherein the oil includes an effective amount of sulfurized cutting oil additive; and (b) while continuously bathing a surface of a metal work piece in a sulfur-free, liquid coolant, placing the abrasive article in moving abrasive contact with the work piece until the surface attains a precision ground finish.

Also provided is a method of dry precision grinding including the steps of:

(a) providing an abrasive article, comprising 3 to 25 volume % vitreous bond, 3 to 56 volume % MCA abrasive grain, and 28 to 63 volume % pores, wherein substantially all open porosity in the abrasive article is impregnated with an effective amount of a lubricant component consisting of an oil and wax mixture having an oil:wax weight ratio of about 3:1 to about 1:4.

(b) placing the abrasive article in moving abrasive contact with a dry workpiece until the surface attains a precision ground finish;

whereby the surface of the workpiece is substantially free of thermal damage.

DESCRIPTION OF THE PREFERRED EMBODIMENTS

The abrasive articles of the invention comprise vitreous bonded abrasive tools. Any vitreous bonded abrasive tool which can be formed by firing abrasive grain in a vitrified bond matrix at elevated temperature is suitable, provided the fired abrasive structure contains pores capable of being filled with a lubricant component.

Preferably the abrasive grain will be a microcrystalline alpha alumina (MCA) abrasive grain. The term "MCA abrasive grain" refers to alumina grain having a specific type of dense, microcrystalline, alpha-alumina morphology, manufactured by any one of a number of seeded or unseeded processes for making sintered sol gel ceramic materials. Preferred abrasive grain for use herein may be obtained from Saint-Gobain Industrial Ceramics Corporation, Worcester, Mass., and from 3M Corporation, Minneapolis, Minn.

As used herein, the term "sintered sol-gel alumina grains" refer to alumina grains made by a process comprising peptizing a sol of an aluminum oxide monohydrate so as to form a gel, drying and firing the gel to sinter it, and then breaking, screening and sizing the sintered gel to form polycrystalline grains made of alpha alumina microcrystals (e.g., at least about 95% alumina).

In addition to the alpha alumina microcrystals, the initial sol may further include up to 15% by weight of spinel, mullite, manganese dioxide, titania, magnesia, rare earth metal oxides, zirconia powder or a zirconia precursor (which can be added in larger amounts, e.g. 40 wt % or more), or other compatible additives or precursors thereof. These additives are often included to modify such properties as fracture toughness, hardness, friability, fracture mechanics, or drying behavior.

Many modifications of alpha alumina sintered sol gel abrasive grain have been reported. All grains within this class are suitable for use herein and the term MCA grain is defined to include any grain comprising at least 60% alpha alumina microcrystals having at least 95% theoretical density and a Vickers hardness (500 grams) of at least 18 GPa. The microcrystals typically may range in size from about 0.2 up to about 1.0 microns, preferably less than 0.4 microns, for seeded grain, and from greater than 1.0 to about 5.0 microns for unseeded grain.

Once the gel has formed, it may be shaped by any convenient method such as pressing, molding or extrusion and then carefully dried to produce an uncracked body of the desired shape. The gel can be shaped and cut into suitable sizes for firing or simply spread out to any convenient shape and dried, typically at a temperature below the frothing temperature of the gel. Any of several dewatering methods, including solvent extraction, can be used to remove the free water of the gel to form a solid. After the solid is dried, it can be cut or machined to form a desired shape or crushed or broken by any suitable means, such as a hammer or ball mill, to form particles or grains. Any method for comminuting the solid can be used. After shaping, the dried gel can then be calcined to remove essentially all volatiles and transform the various components of the grains into ceramics (metal oxides). The dried gel is generally heated until the free water and most of the bound water is removed. The calcined material is then sintered by heating and is held within a suitable temperature range until substantially all of the aluminum oxide monohydrate is converted to alpha alumina microcrystals.

With seeded sol-gel aluminas, nucleation sites are deliberately introduced into or created insitu in the aluminum oxide monohydrate dispersion. The presence of the nucleating sites in the dispersion lowers the temperature at which alpha alumina is formed and produces an extremely fine crystalline structure. Suitable seeds are well known in the art. Generally they have a crystal structure and lattice parameters as close as possible to those of alpha alumina. Seeds that may be used include for example particulate alpha alumina, alpha ferric oxide ($Fe_2O_3$), and precursors of alpha alumina or alpha ferric oxide which convert respectively to alpha alumina or alpha ferric oxide at a temperature below the temperature at which alumina monohydrate would transform to alpha alumina. These seed types are, however, given as illustration and not as a limitation. The seed particles to be effective should preferably be submicron in size.

Preferably, if a seeded sol-gel alumina is used, the amount of seed material should not exceed about 10 weight % of the hydrated alumina and there is normally no benefit to amounts in excess of about 5 weight %. If the seed is adequately fine (a surface area of about 60 $m^2$ per gram or more), preferably amounts of from about 0.5 to 10 weight %, more preferably about 1 to 5 weight %, may be used. The seeds may also be added in the form of a precursor which converts to the active seed form at a temperature below that at which alpha alumina is formed.

Unseeded sol-gel alumina abrasive also may be used. This abrasive can be made by the same process described above except for the introduction of seed particles. Sufficient rare earth metal oxides or their precursors may be added to the sol or gel to provide at least about 0.5% by weight and preferably about 1 to 30% by weight rare earth metal oxide after firing. Other crystal modifiers, such as MgO, may be used to make sol gel alumina abrasive for use herein.

The preferred MCA grain for use according to the present invention is selected from seeded and unseeded sol gel alumina grain, as described by Leitheiser et al., (U.S. Pat. No. 4,314,827); Schwabel (U.S. Pat. No. 4,744,802); Cottringer et al. (U.S. Pat. No. 4,623,364), Bartels et al. (U.S. Pat. No. 5,034,360), Hiraiwa, et al. (U.S. Pat. No. 5,387,268), Hasegawa, et al. (U.S. Pat. No. 5,192,339), and Winkler, et al. (U.S. Pat. No. 5,302,564), the disclosures of which are hereby incorporated by reference.

The abrasive tools of the invention comprise MCA abrasive grain, a vitrified bond, typically with 28 to 68 volume % porosity in the tool, and, optionally, one or more secondary abrasive grains, fillers and/or additives. The abrasive tools comprise 3 to 56 volume % MCA abrasive grain, preferably 10 to 56 volume %. The amount of abrasive grain used in the tool and percentage of secondary abrasive may vary widely. The compositions of the abrasive tools of the invention preferably contain a total abrasive grain content from about 34 to about 56 volume %, more preferably from about 40 to about 54 volume %, and most preferably from about 44 to about 52 volume % grain.

The MCA abrasive preferably provides from about 5 to about 100 volume % of the total abrasive grain of the tool and more preferably from about 30 to about 70 volume % of the total abrasive in the tool.

When secondary abrasive grains are used, such abrasive grains preferably provide from about 0.1 to about 80 volume % of the total abrasive grain of the tool, and more preferably, from about 30 to about 70 volume %. The secondary abrasive grains which may be used include, but are not limited to, alumina oxide, alumina zirconia, silicon carbide, cubic boron nitride, diamond, flint and garnet grains, and combinations thereof.

The compositions of the abrasive tools contain porosity to carry the lubricant component of the tool. The compositions of the abrasive tools of the invention preferably contain from about 28 to about 63 volume % open porosity, more preferably contain from about 28 to about 56 volume %, and most preferably contains from about 30 to about 53 volume %. The porosity may be formed by the inherent spacing created by the natural packing density of the materials used to make the abrasive tool or by a combination of inherent spacing and the addition to the abrasive tool of conventional pore inducing media, including, but not limited to, hollow glass beads, ground walnut shells, beads of plastic material or organic compounds, foamed glass particles and bubble alumina, and combinations thereof. The porosity consists of two types: open porosity and closed porosity. Closed porosity is formed, for example, by the addition of bubble alumina and other hollow body, closed wall spacer materials added to the abrasive tools. Open porosity is the remaining void areas within the tool which permit the flow of air and other fluids into and out of the tool body. Open porosity is created either by controlled spacing of components during molding, pressing and firing and/or by the use of pore forming materials, such as particles of organic materials, which are burned out during firing of the vitrified bond, leaving voids in the bond. As used herein, "open porosity" is interconnected porosity that is available for impregnation with the lubricant component of the invention.

The abrasive tools of the present invention are bonded with a vitreous or glassy bond. The vitreous bond used contributes significantly to precision grinding performance of abrasive tools of the present invention. For MCA grain, low firing temperature bonds are preferred to avoid thermal damage to the grain surface which causes loss of MCA grain performance. Examples of suitable bonds for MCA grain are disclosed in U.S. Pat. Nos. 4,543,107; 4,898,597; 5,203,886; 5,401,284; 5,536,283; and U.S. Ser. No. 08/962,482, filed Oct. 31, 1997, which are hereby incorporated by reference. Raw materials suitable for use in these bonds include Kentucky Ball Clay No. 6, Kaolin, alumina, lithium carbonate, borax pentahydrate or boric acid and soda ash, flint and wollastonite. Frits may be used in addition to the raw materials or in lieu of the raw materials. These bond materials in combination preferably contain at least the following oxides: $SiO_2$, $Al_2O_3$, $Na_2O$, $Li_2O$, and $B_2O_3$.

The lubricant component is a waxy material selected for its suitability for impregnating vitrified bonded abrasive tools and effectiveness in enhancing the grinding performance of MCA abrasive grain in wet and dry grinding. The lubricant component is preferably a mixture of oil and wax. The oil is generally a low viscosity, non-polar, hydrophobic liquid. The oil is selected primarily for its ability to lubricate or otherwise treat the surfaces of the tool and work piece during grinding. The oil may also cool the grinding zone. Many of the lubricating and metal working oils known in the art may be used. Representative oils for use in the present invention include long chain hydrocarbon petroleum or mineral oils, such as napthenic oils and paraffinic oils; naturally occurring tri-, di- and monoglycerides that are liquid at room temperature, including plant oils, such as rapeseed oil, coconut oil, and castor oil; and animal oils, such as sperm oil. Synthetic oils and mixtures of oils can be used.

The oil can further serve as an internal vehicle to deliver to the grinding zone certain chemically active substances, friction modifiers, and extreme pressure lubricants, such as sulfurized fatty oils, fatty acids, and fatty esters; chlorinated esters and fatty acids; chlorosulfurized additives; and mixtures of them. TRIM® OM-300 metalworking fluid is a preferred commercial oil available from Master Chemical Corporation, Perrysburg, Ohio. It is believed to contain a mixture of petroleum oil, sulfurized lard oil, chlorinated alkene polymer and chlorinated fatty esters.

The second important ingredient of the lubricant component is an oil compatible wax. As used herein, "wax" refers to hydrophobic materials having a solid state at room temperature (i.e., a melting point and a softening point above 30° C., preferably above 40° C., more preferably above 50° C.), such as certain hydrocarbon materials having long chain aliphatic (fatty) oxygen-containing moieties, and, optionally, fatty ester, alcohol, acid, amide or amine, or alkyl acid phosphate groups.

Waxes have been defined as a chemical class including esters of fatty acids with alcohols other than glycerol, and, thereby, contrasted from oils and fats which are esters of fatty acids with glycerol. Higher molecular weight saturated hydrocarbons (e.g., at least C12 aliphatic chain) and fatty alcohols (e.g., at least C12 aliphatic chain) are preferred waxes for use herein. The waxes used in the invention comprise a majority of C12–C30 aliphatic groups. For ease of manufacture, preferred waxes have a softening point temperature of about 35 to 115° C. (Ring-and-Ball Apparatus Softening Point Test Method; ASTM E 28–67, 1982) so that they become fluid upon heating for mixing with the oil, yet remain a solid or viscous gel at room temperature. The wax performs some cooling and lubrication, however, its primary function is to encapsulate the oil to prevent oil from seeping out of the abrasive or redistributing within the abrasive prior to grinding, and improve oil film strength at the grinding site. Many natural and synthetic waxes, such as carnauba wax, polyethylene wax, Accu-Lube wax (in gel or solid form, a commercial blend comprising long chain fatty alcohols that is available from ITW Fluid Products Group of Norcross, Georgia) and Micro-Drop wax (a long chain fatty acid-containing product available from Trico Mfg. Corp., of Pewaukee, Wis.), as well as mixtures of these waxes, can be used.

In order to impregnate the vitreous bonded abrasive article, the wax is heated to melting and heated oil is added to the wax with mild agitation until a uniform mixture is obtained. The liquid oil/wax mixture can be impregnated directly into the abrasive or the mixture can be cooled to a solid for subsequent remelting and impregnation. The proportion of oil to wax in the lubricant is governed by the desire to provide as much oil for cooling and lubrication as possible, without permitting the oil to seep from the abrasive. The Accu-Lube and Micro-Drop waxes have relatively low melting points (e.g., less than 50° C.), and are believed to comprise an oil component in an oil to wax weight ratio of at least 1:4. Thus these waxes may be used as the lubricant component to impregnate wheels either with or without blending in an additional amount of an oil.

The lubricant component of the invention preferably contains at least 50 wt % oil. It has been found that up to about 80 wt % oil can be mixed with carnauba wax or polyethylene wax to provide a strong, solid mixture at room temperature. Paraffin wax does not form a suitable mixture with the oil. Accordingly, carnauba wax (also called Brazil wax, a mixture containing esters of hydroxylated unsaturated fatty acids having about 12 carbon atoms in the fatty acid chain, and alcohols and hydrocarbons, with a softening point of about 85° C.) and polyethylene wax (high molecular weight hydrocarbon with a softening point of about 110.5° C.) are preferred waxes for blending with oil to make the lubricant component. Carnauba wax is most preferred.

One can readily determine whether a wax is suitable for use in the present invention by preparing a molten mixture of at least about 50 wt % oil in the wax. The mixture is then permitted to cool. If the cooled mixture solidifies to a uniform consistency (i.e., not lumpy, as determined by visual inspection) and, at room temperature, the solidified product is brittle, not plastic, but snaps when flexed, then the selected ingredients are acceptable.

Waxes having thixotropic viscosity characteristics at the impregnation temperature are preferred for use in the invention. This shear thinning characteristic is beneficial during manufacture of the abrasive tool as well as during the grinding operation. Preferred waxes, e.g., carnauba and polyethylene waxes, and Accu-Lube and Micro-Drop products have appropriate viscosity characteristics at the critical temperature ranges for manufacture and use.

The vitreous bonded abrasive tool is formed by conventional methods. For example, MCA grain and a bond mixture are packed into a wheel preform in a mold to make an uncured abrasive wheel. The uncured wheel then is heated to fire the bond. The uncured MCA grain and bond mixture also can be mixed and molded or shaped to form abrasive segments. After firing, the segments can be bonded or welded to a core of a cutting tool.

In preparation for impregnating the wheel by a preferred, the oil and wax mixture is heated above the melting point of the highest melting wax ingredient. This can be accomplished for example by placing the mixture in a trough submerged in a liquid heat transfer medium bath controlled to an appropriate temperature. Silicone oil is an acceptable medium. The abrasive tool is also heated to a temperature above the melting point of the wax prior to impregnation. While maintained at elevated temperature, the tool is immersed in the liquefied oil/wax mixture for a time sufficient for the mixture to penetrate the pores of the abrasive. A pre-heated wheel can be mounted on a horizontal axis and rotated at a moderately slow circumference speed of about 10–15 cm/s linear velocity. The rotating wheel is then slowly lowered into molten oil/wax mixture, or the mixture may be raised to submerge the abrasive portion of the wheel. Care should be exercised to avoid entraining into the oil/wax mixture air which could prevent thorough impregnation of the pores. The level of the molten oil/wax mixture preferably should be kept below the impregnation level to allow air to escape and avoid air pockets. The weight of the tool may be monitored to determine when sufficient oil/wax has been taken up by the abrasive tool. In the alternative, a visual inspection of the tool will show a slight color change in the wheel as the oil/wax blend penetrates the pores and the process is complete when the entire wheel has changed color. When impregnation is complete, the wheel is preferably slowly removed from the mixture, and allowed to cool. Preferably the wheel should continue to spin until cooling is finished to reduce the potential for creating an unbalanced distribution of lubricant component in the wheel.

In an alternate method for impregnating the wheels of the invention, a flat side of the wheel is placed on a heating plate, a block of the oil/wax mixture is placed on the opposite, top side of the wheel and the plate underneath the wheel is heated to a temperature which is at least as high as the melting temperature of the oil/wax mixture. As the wheel is heated, the oil/wax mixture melts and diffuses into the pores of the wheel, aided by gravity. In an example of this method, impregnation of a 5 inch (127 mm) wheel with Accu-lube lubricant component is carried out by heating the wheel to 100° C. Impregnation is complete in about 10 minutes when the blue colored Accu-lube material becomes visible around the circumference and at the bottom of the wheel. This technique avoids air entrapment and yields a uniformly impregnated wheel. Other methods may be used to manufacture the wheels of the invention, provided a uniform dispersion of the lubricant component into substantially all of the pores of the wheel is achieved.

This invention is now illustrated by examples of certain representative embodiments thereof, wherein all parts, proportions and percentages are by weight unless otherwise indicated. All units of weight and measure not originally obtained in SI units have been converted to SI units.

EXAMPLES

Example 1

The following materials were used in the examples:

| | |
|---|---|
| P.E. Wax | Polyethylene Wax type Polyset 22015 from The International Group, Inc., Wayne, PA |
| Carnauba Wax | Flakes, from Aldrich, Milwaukee, WI (contains a major amount of C24 fatty acids) |
| Paraffin Wax | Fully refined type 1633 (699157 H), from Boler Petroleum Co, Ardmore, PA |
| Accu-Lube gel | from ITW Fluid Products Group, Norcross, GA (GC-MS analysis showed a major amount of a blend of cetyl alcohol and 9-octadecan-1-ol) |
| Micro-Drop wax | from Trico Mfg. Corp., Pewaukee, WI (GC-MS analysis showed a major amount of long chain (≧12C) fatty acids) |
| Sulfur | crystalline sulfur from H.M. Royal, Inc. Trenton, N.J. |
| OM-300 | TRIM ® OM-300 metalworking fluid of petroleum oil with sulfurized oil, chlorinated alkene polymer and chlorinated fatty esters from Master Chemical Corporation, Perrysburg, Ohio |
| OA-770 | 10 wt % sulfur/11.0 wt % chlorine-containing chlorosulfurized metal cutting additive in an oil, from Witco Chemical, Greenwich, Connecticut |
| OA-377 | 36 wt % sulfur-containing sulfurized metal cutting additive in an oil, from Witco Chemical Co. |
| OA-702 | 34.0 wt % chlorine-containing chlorinated ester metal cutting additive in an oil, from Witco Chemical Co. |

Oil/Wax Blending Tests

Comparative Example 1

A sample of P.E. wax (9 g) was melted at about 100° C., and 1 g of solid sulfur was added to the molten wax with hand stirring. The sulfur did not disperse into the wax, but rather remained as a single drop submerged in the wax. This experiment was repeated with camauba wax, paraffin wax, Accu-Lube gel and Micro-Drop wax in place of the P.E. wax. Carnauba wax was heated to about 80° C. and the other waxes were heated to about 50° C. In each case, the sulfur did not mix with the wax. Thus, these samples of sulfur/wax combinations were unacceptable for use in the invention.

Comparative Example 2

A sufficient amount of OM-300 oil was added with stirring to paraffin wax melted as in Comp. Ex. 1 to make a 10 wt % OM-300 oil concentration. The solution was permitted to cool to room temperature. Visual observation showed that the oil and wax did not mix well. The product blend was soft and thus was adjudged "weak" and unacceptable for use in the invention.

Lubricant Component 1

The procedure of Comp. Ex. 2 was repeated with P.E. wax in place of paraffin wax. The OM-300 oil mixed well with the P.E. wax and the product was strong, i.e., at room temperature it was brittle and it snapped when flexed. The experiment was repeated with 25, 40, and 50 wt % OM-300 oil in the mixture, respectively. In each case, the ingredients mixed well, although at 50 wt %, the product appeared to have a bumpy surface. The product blend was considered strong at all concentrations and was acceptable for use in the invention.

Lubricant Component 2

The procedure of Comp. Ex. 2 was repeated with carnauba wax at concentrations of 10, 25, 40, 50, 60 and 75 wt % OM-300 oil. All mixtures were acceptable for use in the invention. Mixtures containing at least 25 wt % were preferred.

Lubricant Component 3

The procedure of Comp. Ex. 2 was repeated with Accu-Lube gel. Product mixtures at 10 and 25 wt % OM-300 oil were judged acceptable for use in the invention.

Lubricant Component 4

The procedure of Comp. Ex. 2 was repeated with Micro-Drop wax. Product mixtures at 10 and 20 wt % OM-300 oil were judged acceptable for use in the invention.

Lubricant Component 5

A 50/50 wt % OM 300 oil/P.E. Wax blend was prepared as in Comp. Ex. 1. The product mixture was strong and acceptable, but appeared lumpy.

Lubricant Component 6

A 50/50 wt % OA-770 oil/carnauba wax blend was prepared as in Comp. Ex. 1. The product mixture was strong and appeared smooth and well-mixed and was acceptable. The product of a mixture of 75/25 wt % OA-770 oil/carnauba wax gave results similar to the 75 wt % OM-300 oil/wax mixture and was acceptable.

Lubricant Component 7

A 50/50 wt % OA-770 oil/P. E. wax blend was prepared as in Comp. Ex. 1. The product mixture was strong and appeared smooth and well-mixed and was acceptable. The same results were obtained with 50/50 wt % mixtures of P. E. wax with OA 377 oil and OA 702 oil, respectively.

Lubricant Component 8

A 50/50 wt % OA-770 oil/Accu-Lube wax blend was prepared as in Comp. Ex. 1. The product mixture was fairly strong and appeared smooth and well-mixed and was acceptable for use in the invention. The same results were obtained with 50/50 wt % mixtures of Accu-Lube with OA 377 oil and OA 702 oil, respectively. The Accu-Lube containing lubricant components were softer than the P.E. or carnauba wax components at room temperature and less desirable for use in the abrasive articles of the invention.

Lubricant Component 9

Coconut oil and carnauba wax mixtures at 25/75, 50/50 and 75/25 wt % were prepared as in Comp. Ex. 2 and found to be well-mixed and acceptable for use in the invention. The same results were obtained with 25/75, 50/50 and 75/25 wt % mixtures of coconut oil with Accu-Lube gel and Micro-Drop wax, respectively. At 50 and 75 wt % of coconut oil in either Accu-Lube or Micro-Drop, the mixtures were fairly soft at room temperature and, thus, less desirable for use as a treatment for abrasive articles than the mixtures containing less than 50 wt % coconut oil.

Lubricant Component 10

Castor oil and carnauba wax mixtures at 25/75, 50/50 and 75/25 wt % were prepared as in Comp. Ex. 2 and found to be well-mixed and acceptable for use in the invention. The same results were obtained with 25/75, 50/50 and 75/25 wt % mixtures of castor oil with Accu-Lube gel and Micro-Drop wax, respectively. At 50 and 75 wt % of castor oil in either Accu-Lube or Micro-Drop, the mixtures were fairly soft at room temperature and, thus, less desirable for use as a treatment for abrasive articles than the mixtures containing less than 50 wt % castor oil.

Lubricant Component 11

Rapeseed oil and carnauba wax mixtures at 40/60, 50/50, 60/40, 70/30 and 80/20 wt % were prepared as in Comp. Ex. 2 and found to be well-mixed and acceptable for use in the invention. The same results were obtained at the same wt percentages with mixtures of rapeseed oil with Accu-Lube gel and Micro-Drop wax, respectively. At 50 wt % and higher amounts of rapeseed oil in either Accu-Lube or Micro-Drop, the mixtures were fairly soft at room temperature and, thus, less desirable for use as a treatment for abrasive articles than the mixtures containing less than 50 wt % rapeseed oil.

These blending tests show that a lubricant component suitable for impregnating the abrasive tools of the invention can be made as a simple heated mixture of selected waxes and oil. Carnauba wax and P.E. wax were the best wax carriers for large quantities of oil, and therefore, the preferred waxes for use in the oil/wax mixture lubricant component of the invention.

The lubricant component could not be prepared by mixing wax with elemental sulfur. If sulfur was used, it had to be added to the wax as an additive in a cutting oil vehicle to ensure distribution of the sulfur.

Paraffin wax was not suitable for use in the lubricant component of the invention. Unlike carnauba wax, paraffin wax is tacky and causes loading of the grinding wheel face. In addition, paraffin wax could not be blended with oils to form an oil/wax mixture.

Wax Yield Value and Viscosity Measurements

Waxes (paraffin, carnauba, polyethylene, Micro-drop and Accu-lube waxes) were tested for viscosity changes over a range of shear rates at five temperature points between 25° C. and the melting point of each wax. The tests were conducted on a Kayeness Galaxy IV Capillary Rheometer, obtained from Kayeness, Inc., Honey Brook, Pa., which was operated at the force values, ram rates and shear rates shown in the table below. The Rheometer was equipped with a sample capillary tube 8.00 mm in length with a 1.05 mm orifice diameter. The viscosity of the waxes were calculated from the shear stress and rates by the formula: $\eta=\tau/\gamma$; where $\eta$ is the viscosity in Poise, $\tau$ is the shear stress in kilodynes/cm$^2$, and $\gamma$ is the shear rate in se$^{-1}$. For each wax, a linear relationship existed between log shear rate and log viscosity values across the temperatures tested.

Waxes suitable for use in the lubricant component of the invention were characterized by shear-thinning (or thixotropic) viscosity behavior as the shear rate increased over all temperatures tested.

Wax Yield Values and Log Viscosity Table

| | | | | Log Viscosity | | | | |
|---|---|---|---|---|---|---|---|---|
| Force Kg | Ram Rate cm/min | Shear Rate sec$^{-1}$ | Log Shear Rate | Accu-lube wax 45° C. | Parafin wax 45° C. | Micro-drop wax 35° C. | Carnauba wax 75° C. | P.E. wax 90° C. |
| 38.1 | 30.480 | 399.00 | 2.601 | 2.48714 | 3.93465 | 4.35516 | 3.72222 | 2.58995 |
| 19.6 | 5.080 | 66.54 | 1.823 | 3.26576 | 4.42503 | 5.06154 | 4.60478 | 3.27989 |
| 7.5 | 0.610 | 7.98 | 0.902 | 3.70935 | 4.92684 | 6.03384 | 5.32635 | 4.05177 |
| 2.9 | 0.102 | 1.33 | 0.124 | 4.26564 | 5.30042 | 6.96011 | 5.93466 | 4.71795 |
| 1.6 | 0.030 | 0.40 | −0.398 | 4.85548 | 5.55445 | — | 6.26565 | 5.21450 |

Example 2

Abrasive Tool Preparation

The following processes were used to impregnate abrasive grinding wheels with the oil/wax mixture and illustrate a preferred method of wheel treatment according to the invention.

Wheel 1

A commercially produced abrasive wheel (5.1×0.52×0.875 inch) (127.0×12.7×22.2 mm) comprising 9.12 volume % vitreous bond, 48 volume % abrasive grain and 42.88 volume % pores was selected. The wheel weighed 556.88 g, including an arbor. The wheel was heated to 150° C. then spun at 17 rev./min. and partially immersed in a 60 wt % OM-300 oil/40 wt % carnauba wax mixture maintained at 110° C. for about 2 to 5 min. Revolution of the wheel in the oil/wax mixture continued until impregnation was visually complete. The wheel was removed from the wax and allowed to cool to room temperature while spinning at the same speed. The weight of the impregnated wheel and arbor was 605.90 g. The wheel had absorbed about 15 wt % of the lubricant component and the pores were substantially full of lubricant component.

Wheel 2

An abrasive wheel (5.1×0.523×0.875 inch) (127.0×12.7×22.2 mm) comprising 9.12 volume % vitreous bond, 48 volume % abrasive grain and 42.88 volume % pores was selected. The wheel weighed 323.50 g, excluding arbor. The wheel was heated to 150° C. then spun at 17 rev./min. and partially immersed in a 50 wt % OA 770 oil/50 wt % carnauba wax mixture maintained at 106° C. for about 2 to 5 min. until impregnation was visually complete. The wheel was removed from the wax and allowed to cool to room temperature while spinning at the same speed. The weight of the impregnated wheel was 373.74 g. The wheel had absorbed about 15 wt % of the lubricant component and the open pores were substantially full of lubricant component.

A cross-section of one of the wheels impregnated by the method described above was prepared and observed to have no visible radial variation in lubricant component impregnation. Thus, substantially all open porosity in the wheels was uniformly impregnated with the lubricant component by using this method of wheel treatment.

Additional wheels were prepared in a similar fashion with each of the oil/wax components used to characterize and define the invention. The wheels were heated to a temperature 20 to 30° C. above the temperature of the liquid lubricant component and each lubricant component was heated until the wax had fully melted (e.g., P.E. wax to 110° C.; carnauba wax to 85° C.; and Accu-Lube and Micro-Drop waxes to 50° C.). For wheel compositions similar to those described above, this technique also yielded treated wheels containing approximately 15 wt % lubricant component.

Example 3

Grinding Test

Lubricant component treated abrasive tools were compared to untreated abrasive tools under dry and wet grinding operations. Samples of seeded sol gel alumina grain/vitrified bonded abrasive wheels (Norton Company's commercial SG8O-K8-HA4 wheels) (5×0.5×0.875 inch) (127.0×12.7×22.2 mm) weighing about 356 g each were selected for the test.

Samples of the grinding wheels (Wheels 9 and 10) were impregnated with a lubricant component mixture of 50 wt % OA-770 chlorosulfurized cutting oil additive and 50 wt % carnauba wax prepared as described in Example 1. The lubricant component was impregnated into the abrasive substantially as described in Example 2 for Wheel 2. The weight of lubricant component impregnated into Wheels 9 and 10 was about 50 g each. Wheel 9 was used to perform the dry cylindrical grinding test described below. Wheel 10 was used in the wet cylindrical grinding test described below.

Another sample of these wheels (Wheel I1) was impregnated with Accu-Lube gel (about 50 g) according to the process of Example 2 (except the wheel was heated to 120° C. and the wax to 88° C.). The treated wheel was used to dry grind the workpiece as described below. Untreated samples of these wheels (Control 3 and Control 4) were used to grind the steel workpiece with and without coolant, respectively.

Grinding Conditions:

Machine: Heald Grinder
Mode: External cylindrical plunge grinding
Wheels: SG80-K8-HA4 (5×0.5×0.875 inch) (127.0×12.7×22.2 mm)
Wheel speed: 6542 rpm (43 m/s)
Work speed: 150 rpm (0.8 mls)
Work material: 52100 steel, cylindrical stock (Rc 60)
102 mm diameter×6.35 mm thickness
Grind width: 6.35 mm
Infeed: 0.76 mm on diameter
Coolant: (If used) E-200 coolant, H.M. Royal, Inc., Trenton, N.J.
Dressing mode: rotary Disc Diamond
2466 rpm
0.005 inch/rev (0.127 mm/rev) lead
0.001 inch (0.025 mm) diametral depth of dress The tests were carried out over a range of infeed rates resulting in applied forces ranging from 22 to 133 N. Test details and results of grinding at an applied force of 88.96 N are shown in Table I.

The results demonstrate that in the absence of an externally applied coolant (i.e., dry grinding), the novel abrasive wheel of the invention yielded a higher G-ratio and higher Grindability (G-ratio/Specific Energy) at lower Specific Energy than any of the non-impregnated abrasive wheels. In both the wet and dry grinding tests, the novel abrasive wheel consumed substantially less power than did either of the non-impregnated wheels. In the wet grinding test, when operated with externally applied coolant, the grindability of the novel abrasive wheel was very similar to that of the non-impregnated wheels at all applied forces.

Thus, the wheels of the invention offer significant improvements for grinding operations wherein workpiece burn must be avoided and external coolant is undesirable for environmental or other reasons.

TABLE 1

| Wheel Sample | Wheel Treatment | Work Mat'l. Rem'v'd (mm) | Fn' (N/mm) | MRR ($mm^3$/s · mm) | WWR ($mm^3$/s · mm) | G Ratio | Unit Power (W/mm) | Specific Energy W · s/$mm^3$ | Grinda-bility $mm^3$/J |
|---|---|---|---|---|---|---|---|---|---|
| Control 3-1 | None; No external coolant | 0.813 | 7.51 | 4.825 | 0.169 | 28.5 | 163.78 | 33.94 | 0.84 |
| Control 3-2 | None; External coolant | 0.787 | 7.17 | 4.964 | 0.186 | 26.7 | 151.18 | 30.46 | 0.88 |

TABLE 1-continued

| Wheel Sample | Wheel Treatment | Work Mat'l. Rem'v'd (mm) | Fn' (N/mm) | MRR ($mm^3$/s · mm) | WWR ($mm^3$/s · mm) | G Ratio | Unit Power (W/mm) | Specific Energy W · s/$mm^3$ | Grinda-bility $mm^3$/J |
|---|---|---|---|---|---|---|---|---|---|
| 9 | 50/50 wt % wax/OA-770 oil; No external coolant | 0.813 | 3.51 | 7.620 | 0.187 | 40.7 | 119.68 | 15.71 | 2.59 |
| 10 | 50/50 wt % wax/OA-770 oil; External coolant | 0.762 | 7.98 | 4.312 | 0.166 | 25.9 | 138.58 | 32.14 | 0.81 |
| 11 | Accu-Lube; No external coolant | 0.813 | 5.09 | 6.735 | 0.159 | 42.4 | 151.18 | 22.45 | 1.89 |

MRR is the metal removal rate, WWR is the wheel wear rate and the G Ratio is the ratio MRR/WWR.

Example 4

Grinding Test

This example illustrates the benefits, relative to an untreated control sample, of various lubricant component treated wheels. The carnauba wax was used at either 100 weight % of the lubricant components or at 20 weight %, in combination with either castor oil, coconut oil or rapeseed oil.

Test wheels (Norton Company's commercial SG80-K8-HA4 wheels) were impregnated by the method described in Example 2. The control and test wheels contained about 48 volume % seeded sol-gel alumina abrasive grain, 9.12 volume % vitrified bond and about 42.88 volume % porosity. The wheel weights following impregnation are shown below.

| Wheel Sample | Treatment | Fired Density (g/cc) | Initial Weight (g) | Final Weight (g) | Amount Absorbed (g) |
|---|---|---|---|---|---|
| Control 4–1 | None | 2.090 | 355.87 | 355.87 | — |
| 12 | 80/20 Castor Oil/ Carnauba Wax | 2.090 | 355.78 | 409.86 | 54.08 |
| 13 | 80/20 Coconut Oil/ Carnauba Wax | 2.086 | 355.86 | 408.44 | 52.58 |

-continued

| Wheel Sample | Treatment | Fired Density (g/cc) | Initial Weight (g) | Final Weight (g) | Amount Absorbed (g) |
|---|---|---|---|---|---|
| 14 | 80/20 Rapeseed Oil/Carnauba Wax | 2.090 | 355.84 | 409.75 | 53.91 |
| Control 4–2 | 100% Carnauba Wax | 2.085 | 355.07 | 405.16 | 50.09 |

The carnauba wax base treated samples and control samples were evaluated in a dry grinding outer diameter grinding test under the following conditions. The results are shown in Table II.

Grinding Conditions:

Machine: Heald Grinder

Mode: External cylindrical plunge grinding

Wheels: SG80-K8-HA4 (5×0.5×0.875 inch) (127.0×12.7×22.2 mm)

Wheel speed: 6280 rpm (42 m/s)

Work speed: 150 rpm (0.8 m/s)

Work material: 52100 steel, round stock (Rc 60)

4.0 inch (101.6 mm) O.D.×0.25 inch (6.35 mm) thickness

Coolant: none

Dressing mode: rotary Disc Diamond 0.005 inch/rev (0.127 mm/rev) lead 0.001 inch (0.025 mm) diametral depth of dress

TABLE II

| Wheel Sample | Treatment | Applied Force (N) | Work Mat'l. Rem'v' (mm) | Fn' (N/mm) | MRR ($mm^3$/s · mm) | WWR ($mm^3$/s · mm) | G Ratio | Unit Power (W/mm) | Specific Energy W · s/$mm^3$ | Grinda-bility $mm^3$/J |
|---|---|---|---|---|---|---|---|---|---|---|
| Control 4-1 | None | 88.96 | 1.0 | 8 | 5.52 | 0.07 | 75.7 | 157.48 | 28.51 | 2.65 |
| | | 133.44 | 1.0 | 15 | 5.90 | 0.14 | 42.3 | 211.65 | 35.90 | 1.18 |
| 12 | 80/20 Castor Oil/Carnauba Wax | 88.96 | 1.0 | 6 | 8.47 | 0.16 | 51.4 | 149.92 | 17.71 | 2.90 |
| | | 133.44 | 1.0 | 11 | 10.75 | 0.21 | 50.3 | 199.05 | 18.51 | 2.72 |
| 13 | 80/20 Coconut Oil/Carnauba Wax | 88.96 | 1.0 | 6 | 7.92 | 0.17 | 45.54 | 149.92 | 18.93 | 2.41 |
| | | 133.44 | 1.0 | 10 | 11.42 | 0.26 | 42.79 | 226.77 | 20.18 | 2.12 |
| 14 | 80/20 Rapeseed Oil/Carnauba | 88.96 | 1.0 | 6 | 8.72 | 0.20 | 43.30 | 137.32 | 15.75 | 2.75 |
| | | 133.44 | 1.0 | 9 | 12.29 | 0.34 | 35.77 | 202.83 | 16.51 | 2.17 |

TABLE II-continued

| Wheel Sample | Treatment | Applied Force (N) | Work Mat'l. Rem'v' (mm) | Fn' (N/mm) | MRR ($mm^3$/s · mm) | WWR ($mm^3$/s · mm) | G Ratio | Unit Power (W/mm) | Specific Energy W · s/$mm^3$ | Grinda-bility $mm^3$/J |
|---|---|---|---|---|---|---|---|---|---|---|
| Control 4-2 | Wax 100% Carnauba Wax | 88.96 | 1.0 | 6 | 8.07 | 0.15 | 53.97 | 149.92 | 18.58 | 2.91 |
| | | 133.44 | 1.0 | 10 | 11.45 | 0.19 | 60.36 | 221.73 | 19.37 | 3.12 |

All treated samples were superior to the untreated control sample in surface finish. At higher applied force levels, all treated samples were superior to the untreated control sample in grinding efficiency and power parameters. The untreated control sample had higher G-ratios at lower applied force levels, but the G-ratio and the material removal rate rapidly decreased as more force was applied. This is a highly undesirable characteristic in precision grinding operations which was largely eliminated by the wheels of the invention. Most notably, in this dry grinding test the Specific Energy needed to grind and the Grindability index (G-ratio/Specific Energy) were significantly superior for the treated wheels than for the untreated wheels.

At all applied forces, the power, G-ratio, surface finish and Grindability of the oil/wax component samples were similar to, or slightly better than, the 100% carnauba wax control sample. It was observed that the 100% carnauba wax treated wheel left an undesirable, difficult to remove, residue on the workpart after grinding. The wax/oil blends also left a residue on the workpart, but, unlike the 100% wax residue, the wax/oil residue was easily wiped off from the workpart. The carnauba wax residue may cause loading of the wheel face during certain grinding operations.

Example 5

Grinding Test

This example illustrates the benefits, relative to sulfur treated control samples, of the lubricant component treated wheels containing a range of weight percentages of carnauba wax to sulfur-containing oils. These samples were also compared with a lubricant component containing a 1:3 ratio of carnauba wax and oil without additives. The treated wheels and controls were tested in an I.D. plunge grinding test under the wet grinding conditions needed to avoid combustion of the sulfur treated control wheels.

Test wheels (Norton Company's commercial SG80-J8-VS wheels) (3.0×0.5×0.875 inch) (76.0×12.7×22.2 mm) were impregnated by the method described in Example 2. The wheels contained about 48 volume % seeded sol-gel alumina abrasive grain, 7.2 volume % vitrified bond and about 44.8 volume % porosity. The wheel weights following impregnation are shown below. The sulfur control wheel was a commercial wheel impregnated with about 15 wt % elemental sulfur (SG80-J8-VS-TR22) that was obtained from Norton Company, Worcester, Mass.

| Wheel Sample | Treatment | Fired Density (g/cc) | Initial Weight (g) | Final Weight (g) | Amount Absorbed (g) |
|---|---|---|---|---|---|
| Control 6–1 | None | 2.202 | 136.42 | 136.42 | — |
| 18 | 75/25 OM-377 Oil/Carnauba Wax | 2.187 | 136.49 | 153.73 | 17.24 |
| 19 | 40/60 OM-377 Oil/Carnauba Wax | 2.201 | 136.56 | 156.88 | 20.32 |
| 20 | 60/40 OM-377 Oil/Carnauba Wax | 2.204 | 136.46 | 157.57 | 21.11 |
| 21 | 20/80 OM-377 Oil/Carnauba Wax | 2.203 | 136.51 | 155.38 | 18.87 |
| 22 | 75/25 OM-300 Oil/Carnauba Wax | 2.198 | 136.73 | 155.79 | 19.06 |
| Control 6–2 | 100% Sulfur commercial | 2.204 | 136.59 | 173.36 | 36.77 |

Grinding Conditions:

Machine: Heald CF #2 Grinder

Mode: Wet I.D. plunge grinding

Wheels: SG80-K8 VS (3×0.5×0.875 inch) (76.0×12.7×22.2 mm)

Wheel speed: 11,307 rpm (44 m/s)

Work speed: 150 rpm (0.8 m/s)

Work material: 52100 steel (Rc 60)

(7.0×0.250×4.0 inch) (178.8×6.35×101.6 mm)

Infeed: 1.524 mm on diameter

Infeed Rates: (2 settings) 2.44 and 4.88 mm/min

Coolant: TRIM® clear coolant (1:20 with deionized well water), Master Chemical Corp.

Perrysburg, Ohio

Dressing mode: rotary Disc Diamond 0.005 inch/rev (0.127 mm/rev) lead 0.001 inch (0.025 mm) diametral depth of dress

TABLE III

| Wheel Sample | Treatment | Infeed Rate mm/min | MRR ($mm^3$/s · mm) | WWR ($mm^3$/s · mm) | G Ratio | Unit Power (W/mm) | Specific Energy W · s/$mm^3$ | Grinda-bility $mm^3$ J |
|---|---|---|---|---|---|---|---|---|
| Control | None | 2.44 | 5.42 | 0.05 | 108.6 | 378 | 69.79 | 1.56 |
| 6-1 | | 4.88 | 14.73 | 0.16 | 94.1 | 932 | 58.15 | 1.62 |
| 18 | 75/25 OM-377 | 2.44 | 5.87 | 0.04 | 143.1 | 422 | 71.96 | 1.99 |

TABLE III-continued

| Wheel Sample | Treatment | Infeed Rate mm/min | MRR ($mm^3$/s · mm) | WWR ($mm^3$/s · mm) | G Ratio | Unit Power (W/mm) | Specific Energy W · s/$mm^3$ | Grinda-bility $mm^3$ J |
|---|---|---|---|---|---|---|---|---|
| | Oil/Carnauba Wax | 4.88 | 15.23 | 0.14 | 106.6 | 894 | 58.73 | 1.81 |
| 19 | 40/60 OM-377 | 2.44 | 6.04 | 0.04 | 139.2 | 365 | 60.51 | 2.30 |
| | Oil/Carnauba Wax | 4.88 | 14.70 | 0.12 | 123.4 | 743 | 50.58 | 2.44 |
| 20 | 60/40 OM-377 | 2.44 | 5.78 | 0.05 | 128.0 | 403 | 69.74 | 1.84 |
| | Oil/Carnauba Wax | 4.88 | 14.57 | 0.13 | 113.3 | 857 | 58.81 | 1.93 |
| 21 | 20/80 OM-377 | 2.44 | 5.97 | 0.05 | 131.1 | 391 | 65.44 | 2.00 |
| | Oil/Carnauba Wax | 4.88 | 15.01 | 0.13 | 115.9 | 869 | 57.9 | 2.00 |
| 22 | 75/25 OM-300 | 2.44 | 5.93 | 0.05 | 131.8 | 378 | 63.71 | 2.07 |
| | Oil/Carnauba Wax | 4.88 | 15.06 | 0.18 | 84.4 | 794 | 52.7 | 1.60 |
| Control | 100% Sulfur | 2.44 | 6.00 | 0.05 | 124.3 | 517 | 85.46 | 1.45 |
| 6-2 | Commercial | 4.88 | 15.09 | 0.15 | 104.1 | 1058 | 70.13 | 1.48 |

Under wet grinding conditions, the wheels of the invention were superior to sulfur treated wheels in Grindability and Specific Energy, as shown in Table III, demonstrating a desirable balance among performance parameters, including power needed to grind and material removal rates. Thus, the treated wheels of the invention are an acceptable substitute for sulfur impregnated grinding wheels.

All treated wheels (except for the OM-300 oil treated wheel #22) were superior to the untreated control wheel in Grindability, but had equivalent Specific Energy requirements. Although the performance of the OM 300 oil treated wheel 22 was slightly inferior at the higher infeed rate, overall performance was acceptable. Because OM-300 oil contains only a minor amount of sulfur, relative to OM-377 oil, the OM-300 oil treated wheel would be selected for use in grinding operations where sulfur is an environmental problem.

As demonstrated in Example 3, if the treated and untreated wheels had been tested under dry grinding conditions, all wheels impregnated with oil and wax are likely to have demonstrated even higher G-ratios and consumed even less power than untreated control wheel.

Although specific forms of the invention have been selected for illustration in the drawings and examples, and the preceding description is drawn in specific terms for the purpose of describing these forms of the invention, this description is not intended to limit the scope of the invention which is defined in the claims.

We claim:

1. An abrasive article for precision grinding, comprising 3 to 25 volume % vitreous bond, 3 to 56 volume % MCA abrasive grain, and 28 to 63 volume % open porosity, wherein substantially all open porosity in the abrasive article has been impregnated with a lubricant component consisting of a uniform mixture of oil and wax, having an oil:wax weight ratio of about 3:1 to about 1:4.

2. The abrasive article of claim 1 wherein the abrasive article comprises about 10 to 56 volume % MCA abrasive grain and the MCA abrasive grain is selected from the group consisting essentially of sintered seeded sol-gel alumina grain and sintered unseeded sol-gel alumina grain and combinations thereof.

3. The abrasive article of claim 1 wherein the abrasive article further comprises about 0.1 to 53 volume % of at least one secondary abrasive grain.

4. The abrasive article of claim 1 wherein the oil is at least about 60 wt % of the oil and wax mixture.

5. The abrasive article of claim 1 wherein the wax in the oil and wax mixture is carnauba wax.

6. The abrasive article of claim 1 wherein the wax in the oil and wax mixture is a mixture of aliphatic compounds containing a majority of at least one C16 to C24 aliphatic compound.

7. The abrasive article of claim 1 wherein the wax in the oil and wax mixture is polyethylene wax.

8. The abrasive article of claim 1 wherein the wax in the oil and wax mixture comprises esters of fatty acids having a hydrocarbon chain of at least 12 carbon atoms.

9. The abrasive article of claim 1 wherein the oil in the oil and wax mixture includes a sulfurized cutting oil additive.

10. The abrasive article of claim 9 wherein the amount of sulfurized cutting oil additive is at least about 10 wt % of the oil.

11. The abrasive article of claim 1 wherein the abrasive article is a grinding wheel.

12. A method of manufacturing an abrasive article for precision grinding comprising the steps of:

(a) blending about 20–75 wt % oil and 25–80 wt % wax at a temperature above the softening point of the wax to form a uniformly mixed lubricant component;

(b) providing an abrasive article comprising about 3 to 25 volume % vitreous bond, 3 to 56 volume % MCA grain and 28 to 63 volume % open pores;

(c) heating the lubricant component to a temperature where the lubricant component is in a liquid state and holding the lubricant component in a liquid state;

(d) heating the abrasive article to a temperature 20 to 30° C. higher the temperature of the liquid lubricant component;

(e) contacting the abrasive article with the liquid lubricant component without submerging the abrasive article into the liquid lubricant component;

(f) rotating the abrasive article at a speed effective to avoid gas entrainment while maintaining contact with the liquid lubricant component to uniformly impregnate the abrasive article with lubricant component;

(g) removing the abrasive article from contact with the lubricant component after the abrasive article has absorbed an effective amount of lubricant component to fill substantially all open pores; and (h) continuing to rotate the abrasive article while cooling the abrasive article to uniformly solidify the impregnated liquid lubricant component within the pores.

13. The method of claim 12 wherein the wax is carnauba wax and wherein the oil is at least about 60 wt % of the lubricant component.

14. A method of precision grinding comprising the steps of:

(a) providing an abrasive article comprising a vitreous bond and a MCA abrasive grain having pores containing a lubricant component consisting essentially of about 20–75 wt % oil and 25–80 wt % wax; wherein the oil includes a sulfurized cutting oil additive; and (b) while continuously bathing a surface of a metal work piece in a sulfur-free, liquid coolant, placing the abrasive article in moving abrasive contact with the work piece until the surface attains a precision ground finish.

15. The method of claim 14 wherein the amount of sulfurized cutting oil additive is about 10–40 wt % of the oil in the lubricant component of the abrasive article.

16. A method of dry precision grinding including the steps of:

(a) providing an abrasive article, comprising 3 to 25 volume % vitreous bond, 3 to 56 volume % MCA abrasive grain, and 28 to 63 volume % open porosity, wherein substantially all open porosity in the abrasive article is impregnated with a lubricant component consisting of a uniform mixture of oil and wax, having an oil:wax weight ratio of about 3:1 to about 1:4;

(b) placing the abrasive article in moving abrasive contact with a surface of a dry workpiece until the surface attains a precision ground finish;

whereby the surface of the workpiece is substantially free of thermal damage.

17. The method of claim 16 wherein the oil in the oil and wax mixture includes a sulfurized cutting oil additive.

18. The method of claim 17 wherein the amount of sulfurized cutting oil additive is about 10–40 wt % of the oil in the lubricant component of the abrasive article.

* * * * *